US005452889A

United States Patent [19]

Lewinski et al.

[11] Patent Number: 5,452,889

[45] Date of Patent: Sep. 26, 1995

[54] BALL STRIKING DEVICE

[75] Inventors: David P. Lewinski, Cincinnati, Ohio; John F. Mayer, Ft. Thomas, Ky.; Carol L. Guthrie, Cincinnati, Ohio

[73] Assignee: Tonka Corporation, Pawtucket, R.I.

[21] Appl. No.: 192,134

[22] Filed: Feb. 4, 1994

[51] Int. Cl.[6] ..... A63B 59/06

[52] U.S. Cl. ..... 273/72 R; 273/170; 273/67 R; 273/26 B; 446/267

[58] Field of Search ..... 273/72 R, 72 A, 273/73, 167, 170, 26 B; 446/267

[56] References Cited

U.S. PATENT DOCUMENTS 1,499,128 6/1924 Shroyer, Jr. .
1,611,858 12/1926 Middlekauff .
2,099,521 11/1937 Herkimer et al. .
3,479,030 11/1969 Merola .
3,578,801 5/1971 Piazza .
3,623,724 11/1971 Lande .
3,830,496 8/1974 Reizer .
3,955,816 5/1976 Bratt .
4,378,113 3/1983 Piccini .
4,705,273 11/1987 Ament et al. .
5,082,279 1/1992 Hall et al. ..... 273/170

*Primary Examiner*—Mark S. Graham
*Attorney, Agent, or Firm*—Kurt R. Benson

[57] ABSTRACT

A device for striking a ball, such as a soft foam rubber ball, includes a ball striking element including a clear transparent shell portion which is formed in a configuration similar to a device such as a golf club or a baseball bat and a colored liquid in an inner cavity in the shell portion. The colored liquid only partially fills the inner cavity in the shell portion so that it not only acts to transfer weight in the device during a ball striking exercise but to also provide a unique splashing visual effect.

8 Claims, 7 Drawing Sheets

BALL STRIKING DEVICE

BACKGROUND AND SUMMARY OF THE INVENTION

The instant invention relates to athletic equipment and more particularly to a novel and amusing ball striking device which can be effectively embodied in various configurations, including a baseball bat and a golf club.

It has been found that persons of various ages derive substantial amusement from active participation in games such as baseball and golf. It has been further found that participants of informal simulated baseball and golf activities frequently prefer to play with relatively soft balls which, in many cases, are easier to strike and retrieve. This has been found to be particularly true with players involved in baseball-like activities who do not have proper catching gloves, batting helmets, etc or players involved in back yard golf activities. Accordingly, a variety of types of modified baseball and golf equipment which are adapted for use with relatively soft balls, including soft foam rubber balls, have been developed over the years.

In addition, a variety of different techniques have been utilized for providing increased weight to various portions of ball striking devices. For example, baseball bats containing moveable weighted elements which are centrifugally moved outwardly during swinging actions have been heretofore available. However, most of the heretofore available bats of this type have been primarily intended for use in practice or warm-up exercises rather than for hitting balls. In any event, reference is made to the Shroyer, Jr. U.S. Pat. No. 1,499,128; Middlekauf, U.S. Pat. No. 1,611,858; Herkimer, et al, U.S. Pat. No. 2,099,521; Merola, U.S. Pat. No. 3,479,030; Piazza, U.S. Pat. No. 3,578,801; Lende, U.S. Pat. No. 3,623,724; Reizer, U.S. Pat. No. 3,830,496; Bratt, U.S. Pat. No. 3,955,816; Piccini, U.S. Pat. No. 4,378,113 and Ament, et al, U.S. Pat. No. 4,705,273 as representing the closest prior art to the subject invention of which the applicant is aware. However, since these references fail to suggest a ball striking device, which is intended for use in striking a ball and which includes a transparent portion containing a fluid material, they are believed to be of only general interest with respect to the subject invention.

The instant invention provides a novel ball striking device comprising a fluid-filled portion which provides both improved striking characteristics and unique and amusing visual effects. More specifically, the device of the subject invention comprises a ball striking element including a striking portion which is adapted for striking a ball and a handle portion extending from the striking portion. A portion of the ball striking element is constructed from a transparent material, and it has a closed hollow cavity form therein, and the device further comprises a fluid material in the cavity. The fluid material only partially fills the cavity, and it is visible from the exterior of the device through the transparent portion of the ball striking element to provide an amusing visual effect during swinging of the device. The ball striking element preferably comprises a hollow transparent shell which defines the cavity in the ball striking element and which extends substantially the entire length of the ball striking element. The transparent shell preferably forms the striking portion, and it preferably further forms a hollow tubular inner core of the handle portion. The hollow shell is preferably constructed from a colored, but clear, transparent plastic material in a sufficiently durable configuration to enable the striking portion to be utilized for striking a ball during the course of game play without causing damage to the ball striking element. The device preferably further comprises an opaque hand-grip on the inner core of the handle portion for enabling a user to more effectively grip the handle portion of the device. In one embodiment the fluid in the cavity of the device preferably comprises colored water, and the transparent plastic shell is preferably also colored the same color as the water. Further, in one embodiment, the ball striking element is configured to resemble a conventional baseball bat. In this embodiment, the device still further includes an end cap on the outer end of the hitting portion and a fixed upper ring for separating the handle portion from the hitting portion and for retaining the hand-grip in position on the handle portion. In another embodiment, the fluid in the device comprises a mixture of a relatively viscous fluid with a lubricant so that the fluid moves as a unit of relatively viscous material without sticking to the inner walls of the cavity. In still another embodiment the ball striking element is configured to resemble a conventional golf club, and in this case, the fluid can either comprise water or a more viscous fluid.

Accordingly, it is a primary object of the instant invention to provide an amusing ball striking device which is adapted for use in striking relatively soft foam balls.

Another object of the instant invention is to provide an amusing ball striking device comprising an outer shell and a liquid which is flowable in a cavity in the outer shell.

An even still further object of the instant invention is to provide a ball striking device comprising a transparent shell and a colored liquid which is flowable in a cavity in the shell.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
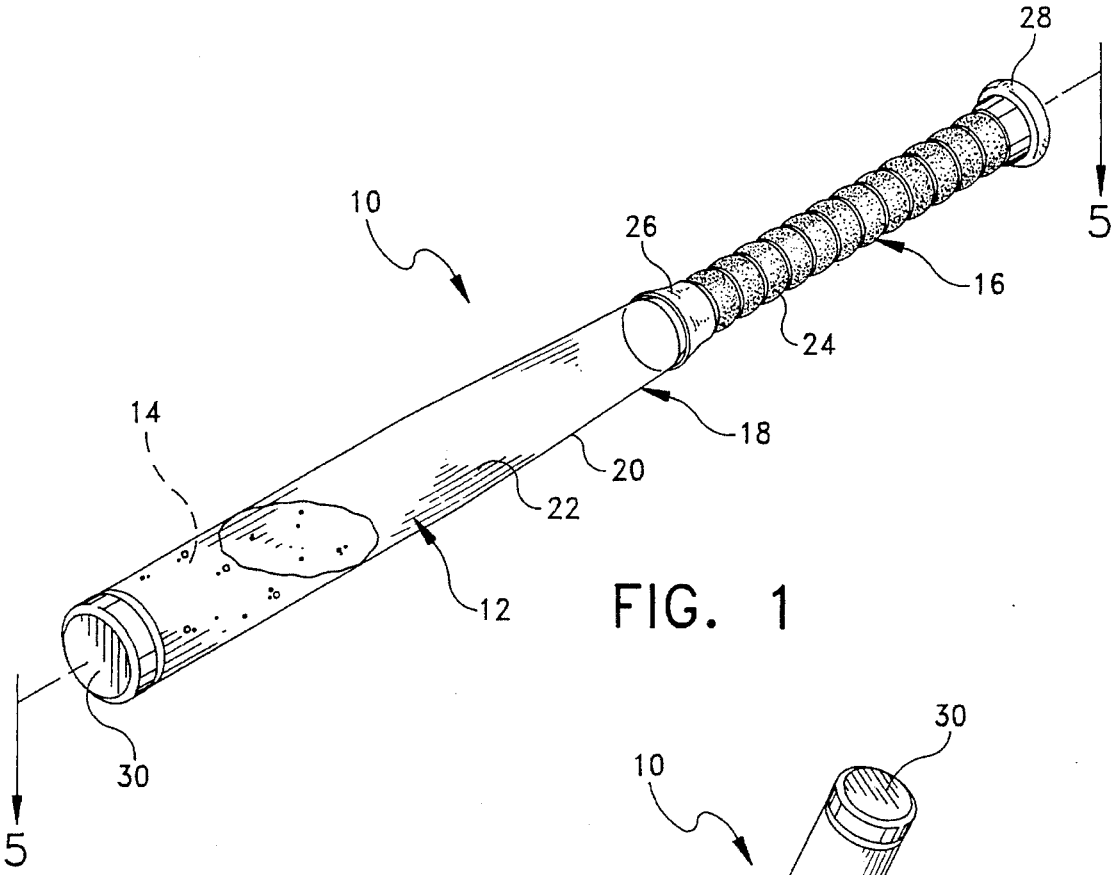
FIG. 1 is a perspective view of a first embodiment of the device of the instant invention.

Referring now to the drawings, a first embodiment of the ball striking device of the instant invention is illustrated and generally indicated at 10 in FIGS. 1 through 5. The device 10, which is configured to resemble a conventional baseball bat, includes a ball striking element generally indicated at 12 and a fluid material 14 which is contained in a hollow inner cavity in the ball striking element 12. The ball striking element 12 comprises a handle portion generally indicated at 16 and a striking portion 18 which extends integrally from the handle portion 16. The ball striking element 12 includes a hollow plastic shell generally indicated at 20 which substantially defines the configuration of the striking portion 18 and an inner core of the handle portion 16. The shell portion 20 is formed in a hollow configuration so that it also defines a closed inner cavity 22. The shell portion 20 is made from a suitable durable rigid, colored, but clear, transparent plastic material so that the ball striking element 12 can be effectively utilized for striking a ball, such as a foam rubber baseball, with the striking portion 18. The device 12 further includes an opaque foam rubber gripping sleeve 24 on the inner core of the handle portion 16 and a rigid plastic upper ring 26 which is permanently secured in inter-fitting engagement with the shell portion 20 so that it defines the intersection between the handle portion 16 and the ball striking portion 18. Accordingly, the ring 26 operates to retain the sleeve 24 in position on the shell portion 20. Also included in the ball striking element 12 is a handle end cap 28 which is preferably also made from a suitable plastic material, and which is received in inter-fitting engagement on the terminal end of the handle portion 16 for protecting the end of the shell portion 20. An end cap 30 is received on the terminal end of the hitting portion 18 for protecting the opposite end of the shell portion 20.

Figure 2:
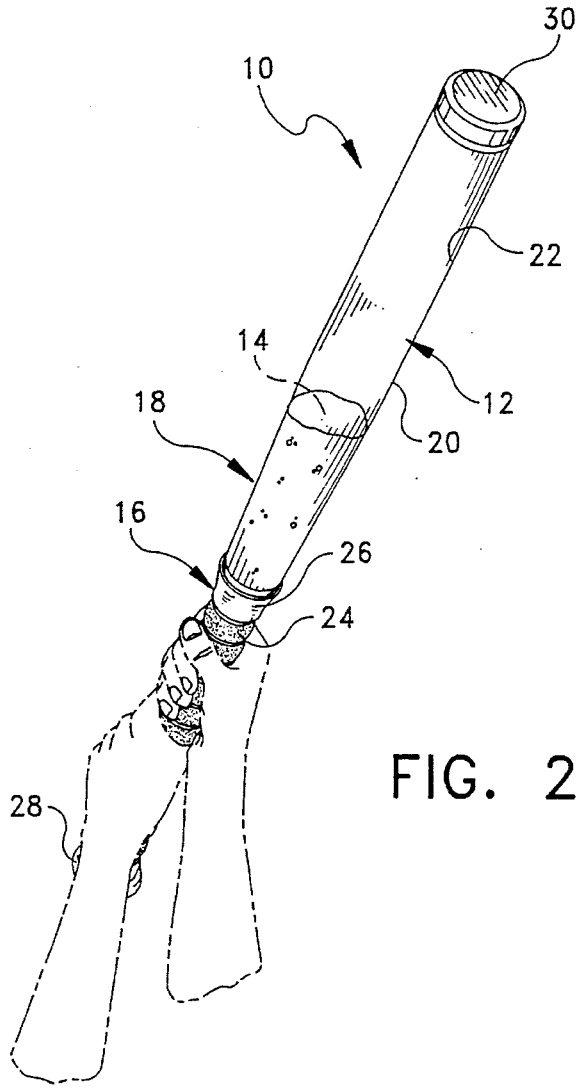
FIGS. 2 through 4 are sequential perspective views thereof as it is swung by a user.

The fluid 14 preferably comprises a colored water solution which only partially fills the cavity 22 defined by the shell portion 20. Accordingly, when the device 10 is held in an upwardly extending disposition, the fluid 14 normally runs downwardly into the end of handle portion 16 as illustrated in FIG. 2, whereas when the device 10 is held in a downwardly extending disposition, the fluid 14 runs downwardly into the terminal end portion of the striking portion 18 as illustrated most clearly in FIG. 5.

Figure 3:
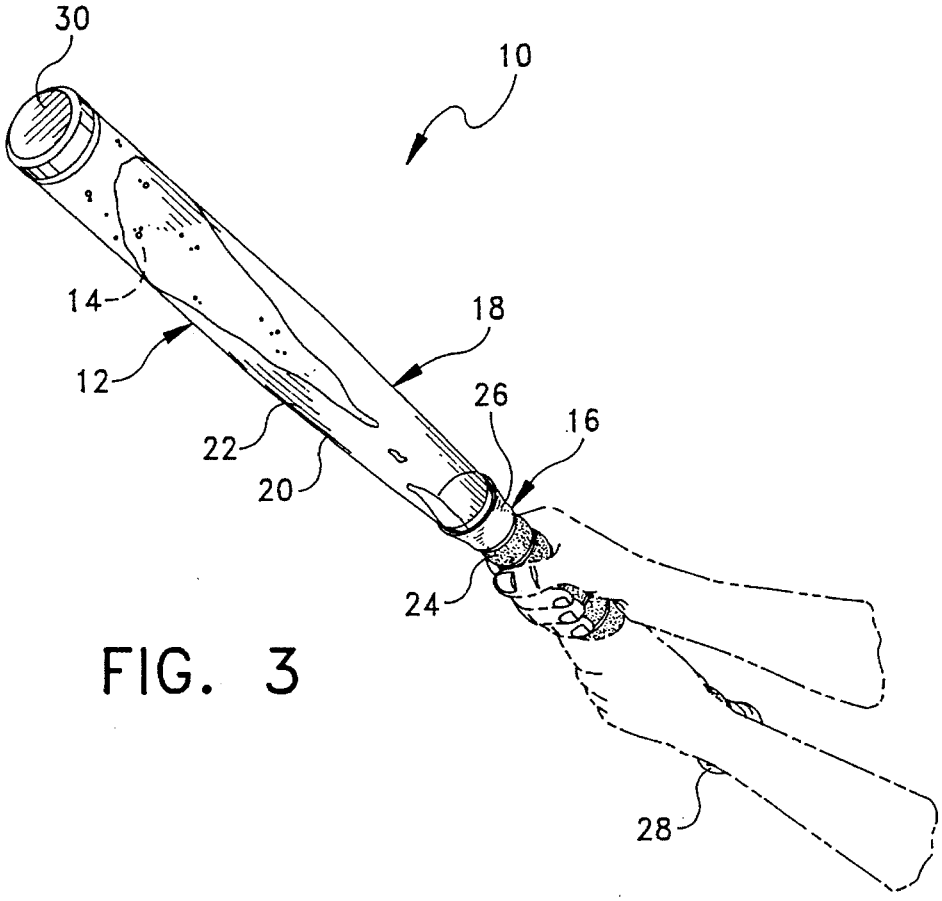
Figure 4:
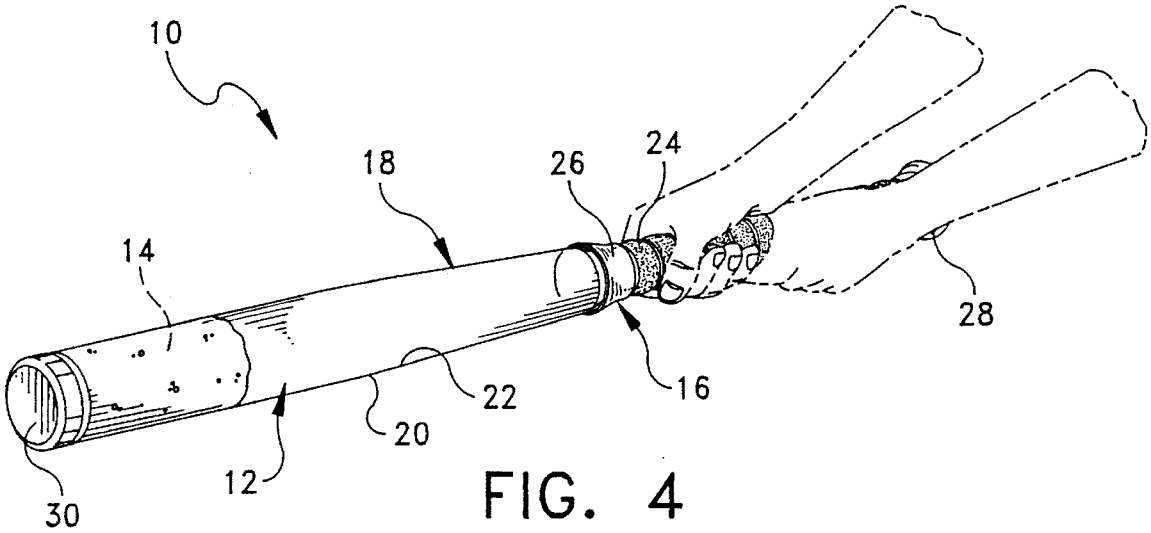
Figure 5:
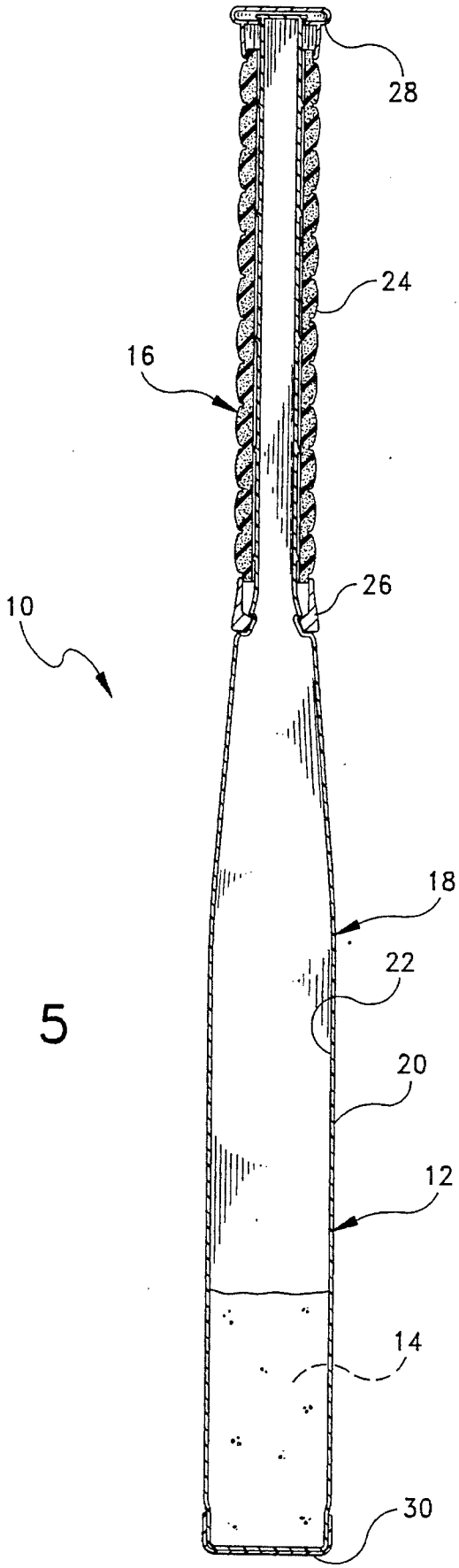
FIG. 5 is a sectional view taken along 5—5 in FIG. 1.

Accordingly, during use of the device 10 in a ball striking exercise, the fluid 14 not only provides increased weight in the striking portion 18 for striking a ball, but it also provides a unique and interesting visual effect as the fluid 14 travels outwardly in the striking portion 18. In this regard, as illustrated in FIGS. 2–4, as a user swings the device 10 in a manner similar to a conventional baseball bat, the fluid 14 is centrifugally moved outwardly in the hitting portion 18 with a dynamic splashing action as the fluid 14 is confined within the shell portion 20. Further, since the fluid 14 preferably comprises a colored water solution, the fluid 14 is clearly visible as it travels rapidly outwardly in the shell portion 20 with a splashing action during a swinging exercise to provide a significantly enhanced levels of appeal and play value.

Figure 6:
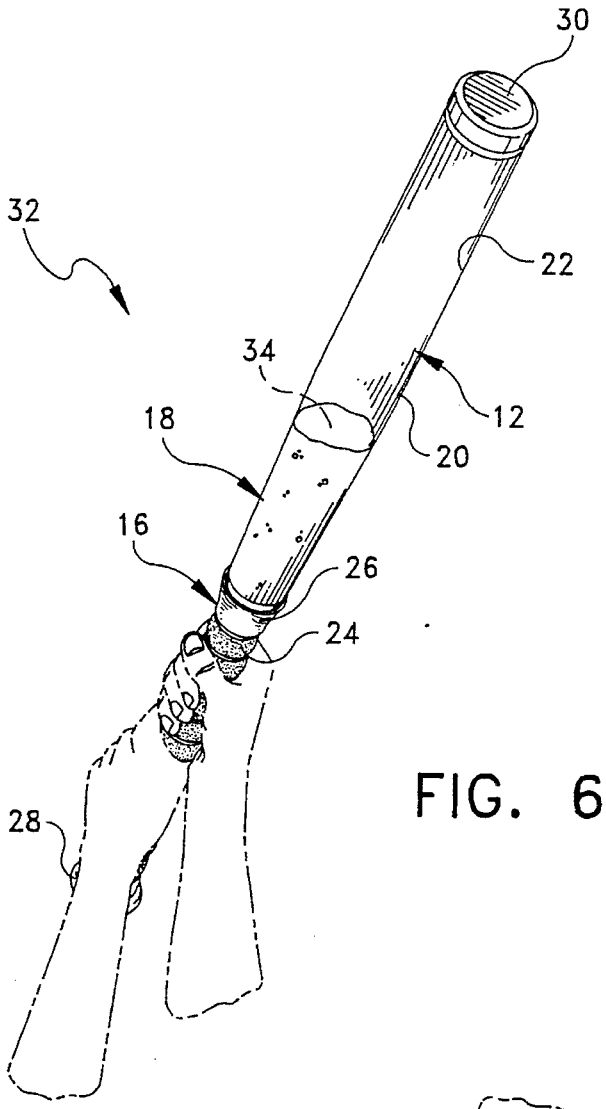
FIGS. 6 and 7 are perspective views of a second embodiment of the device as it is moved from an upwardly extending position to a downwardly extending position.
Figure 7:
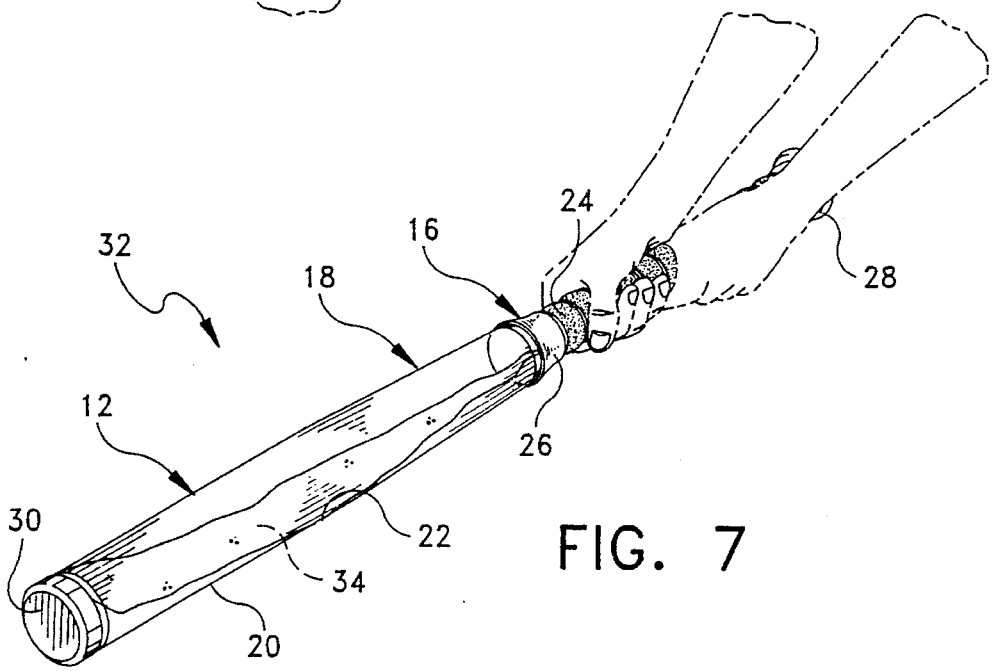
Figure 8:
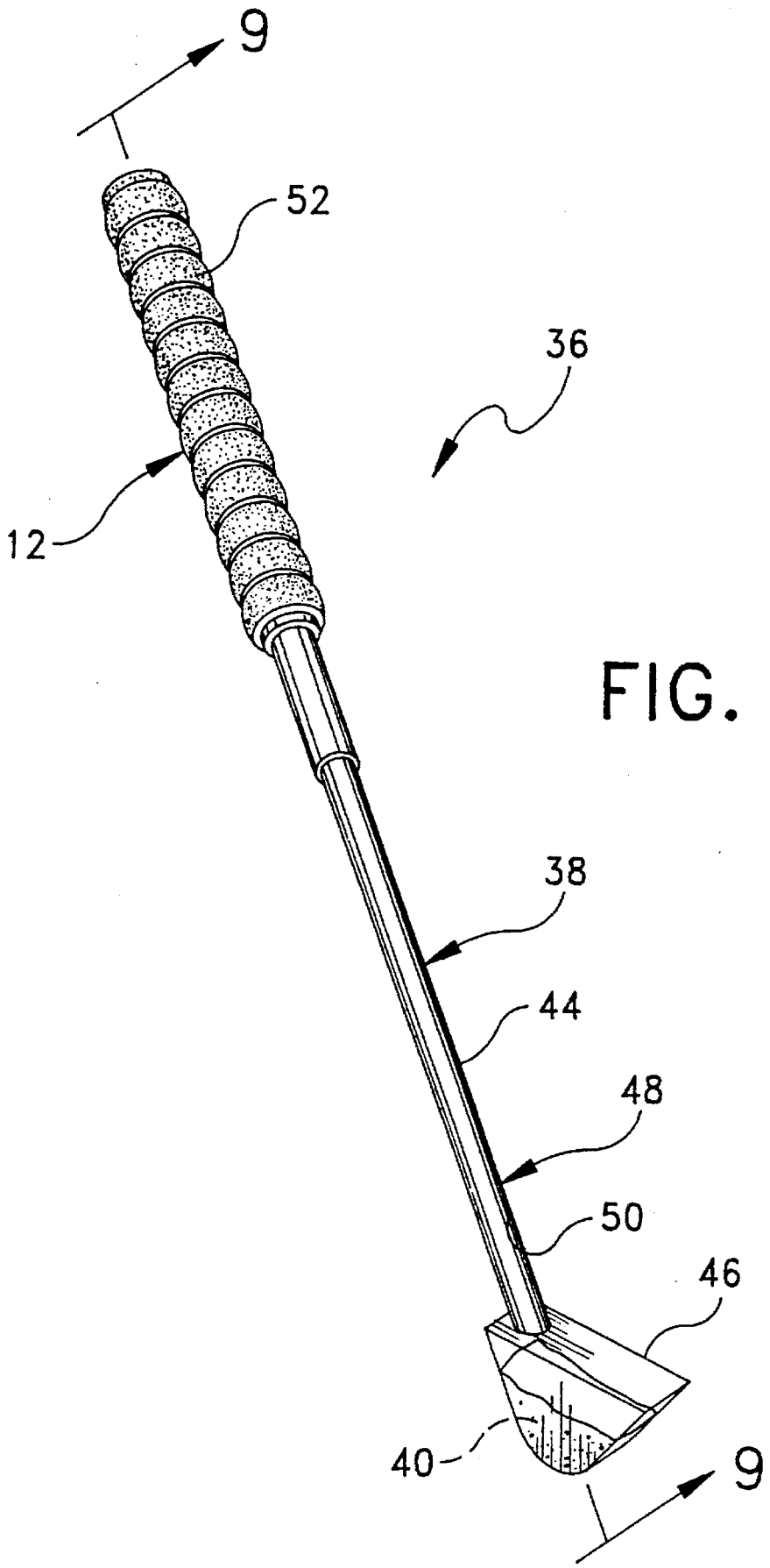
FIG. 8 is a perspective view of a third embodiment of the device.

Referring now to FIGS. 6 and 7, a second embodiment of the device of the instant invention is illustrated and generally indicated at 32. The device 32 comprises a bat element 12, which is identical to the bat element 12 in the bat 10, and it includes a handle portion 16 and a ball striking portion 18. However, the device 32, which is also configured to resemble a baseball bat, includes a two phase viscus fluid 34 which has highly unusual flow characteristics, and, therefore, provides an even further enhanced play value in the device 32. Specifically, the fluid 34 comprises a two phase mixture comprising a thick water-based gel having a viscosity between 1,000 centipoise and 100,000 centipoise and a lubricant oil which is nonmiscible with the gel and which has a viscosity between approximately 50 centistoke and 200 centistoke. In the embodiment herein set forth, the thick liquid gel comprises a polysaccharide polymer solution having a viscosity between 30,000 centipoise and 80,000 centipoise, and the lubricant comprises a silicone oil having a viscosity of approximately 50 centistoke. It will be understood, however, that a variety of other thick liquid gels and lubricants can be effectively utilized for the fluid 34. In any event, as illustrated, the fluid 34 only partially fills the cavity 22 in the shell 20 of the device 32 in a manner similar to the fluid 14 in the shell 20 of the device 10.

During use of the device 32 the fluid 34 is free to travel throughout the cavity 22 in a manner similar to the fluid 14 in the bat 10. However, because of the consistency and viscosity of the fluid 34, it normally travels as a combined mass, although the fluid 34 acts somewhat more gooey or stringy than the fluid 14 to enhance the visual effect provided by the fluid 34 as it parts from the inner walls of the shell portion 20.

Referring now to FIGS. 8 through 12, a third embodiment of the ball striking device is illustrated and generally indicated at 36. The ball striking device 36, which is configured to resemble a conventional golf club, comprises a ball striking element generally indicated at 38 and a fluid material 40 which is contained in a hollow cavity in the ball striking element 38. The ball striking element 38 comprises a handle portion 42, a shank portion 44 and a striking portion 46 which extends integrally from the shank portion 44. The ball striking element 38 includes a hollow plastic shell generally indicated at 48 which substantially defines the configuration of the striking portion or head 46, the shank portion 44 and an inner core of the handle portion 42. The shell portion 48 is formed in a hollow configuration so that it also defines a closed inner cavity 50 which extends throughout the entire ball striking element 38. The shell portion 48 is made from a suitable, durable, rigid, colored, but clear, transparent plastic material so that the striking portion or head 46 can be effectively utilized for striking a ball, such as a foam rubber golf ball, without causing damage to the shell portion 48. The device 36 further includes an opaque foam rubber gripping sleeve 52 on the handle portion 42 for more effectively grasping the handle portion 42 during a golf swinging-type exercise.

Figure 9:
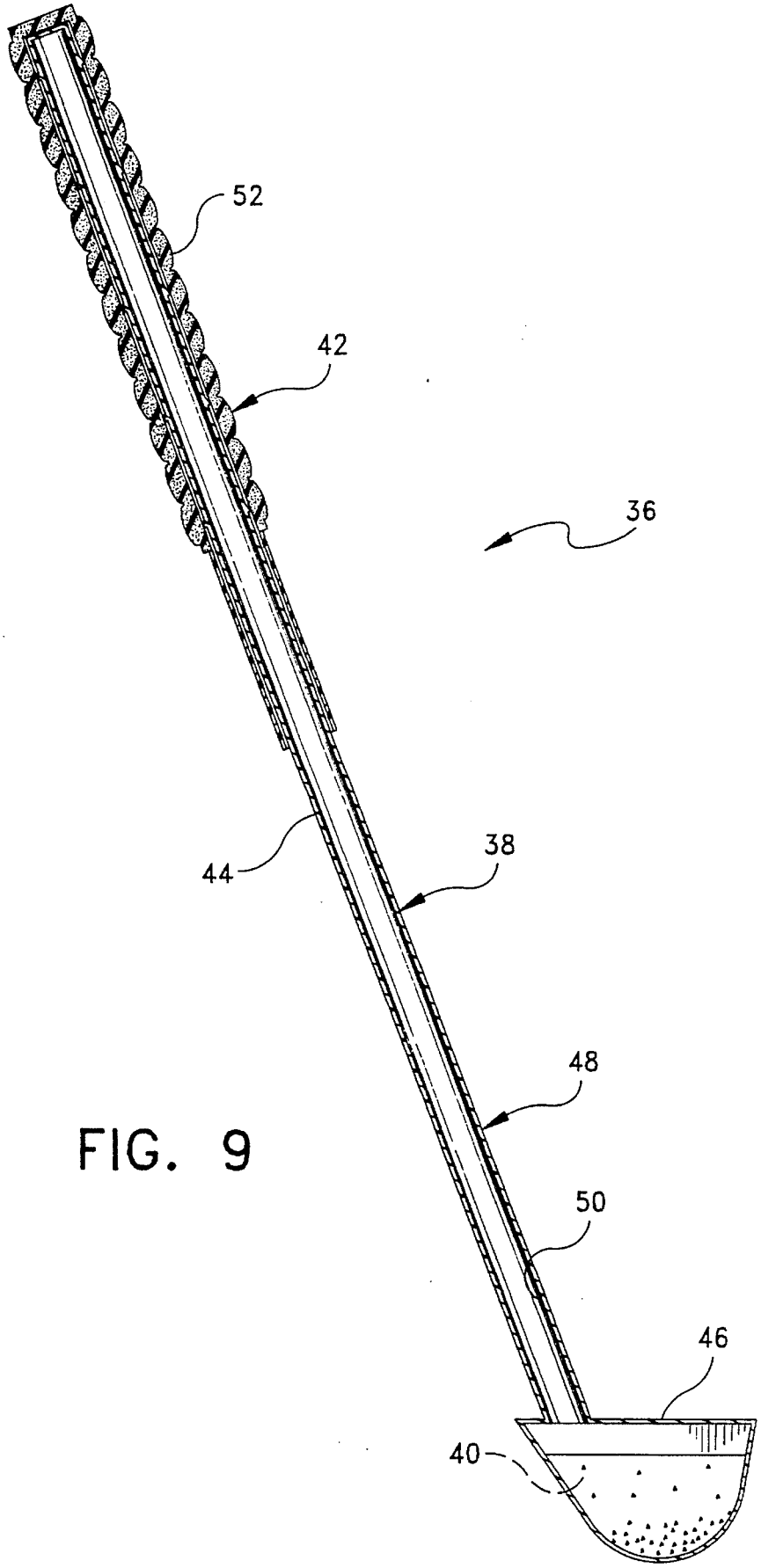
FIG. 9 is a side sectional view thereof taken along line 9—9 in FIG. 8.
Figure 10:
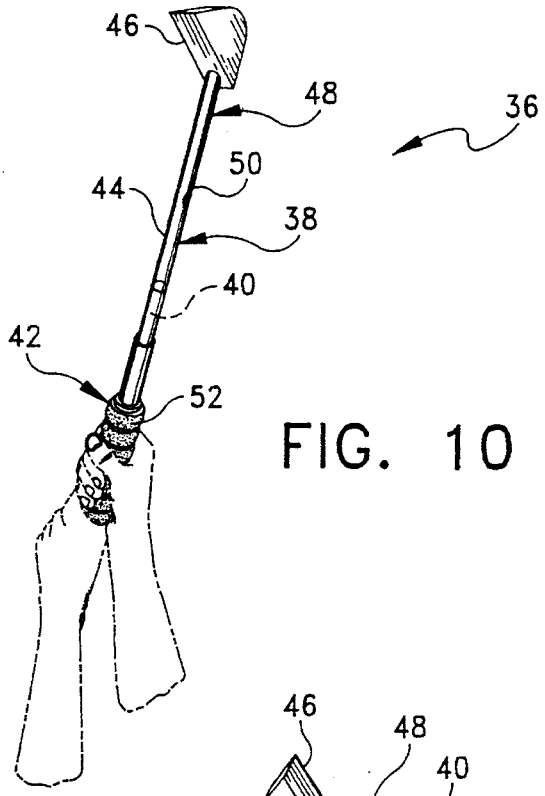
FIG. 10 through 12 are sequential perspective views thereof as it is swung by a user.
Figure 11:
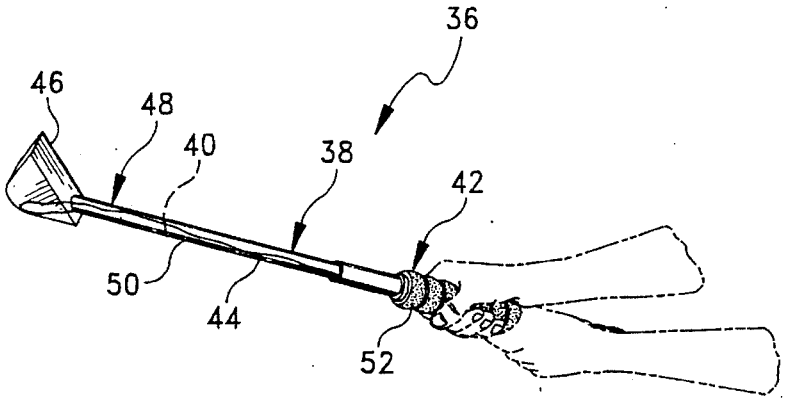
Figure 12:
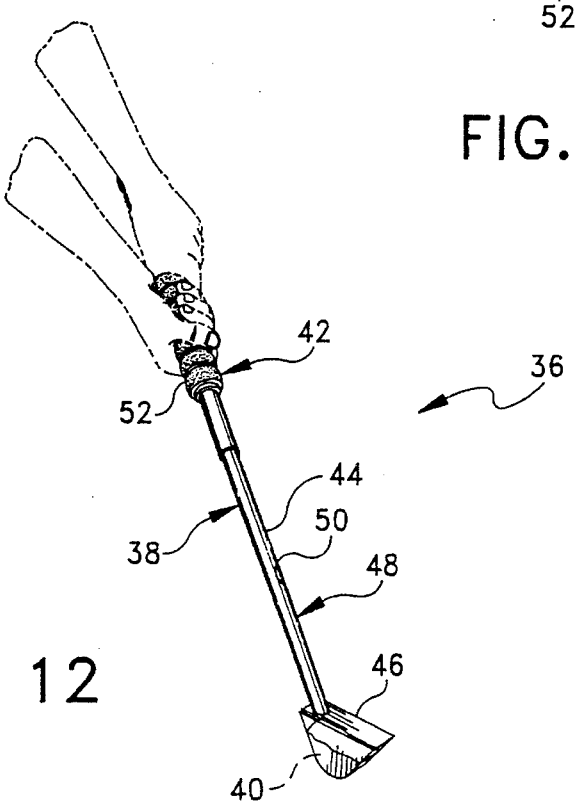

The fluid material 40 preferably comprises a colored water solution which only partially fills the cavity 50, as illustrated most clearly in FIG. 9. Accordingly, as illustrated in FIGS. 10 through 12, when the device 36 is swung in a manner similar to a golf club, the fluid material 40 is moved rapidly outwardly from the handle portion 42 through the shank portion 44 to the striking portion 46 with a dynamic sloshing or splashing action to not only transfer weight to the striking portion, but to also provide a unique and intriguing visual effect. Further, because the fluid 40 preferably comprises a colored liquid it is normally highly visible to enhance the visual effect created as the device 36 is moved through a golf swing.

It is seen, therefore, that the instant invention provides an effective ball striking device which has significant advantages over the previously available devices for striking relatively soft foam rubber balls and the like. The devices 10, 32 and 36 are not only adapted to provide effective weight transfer during swinging actions, but also to provide unique and interesting visual effects during swinging actions and during other times when they are moved by users thereof. Hence, the baseball bat-like devices 10 and 32 and the golf club-like device 36 have significantly enhanced play value, and they represent significant improvements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A device for striking a ball comprising:

a. a ball striking element configured to resemble a baseball bat including a hitting portion and a handle portion, said ball striking element comprising a hollow transparent plastic shell defining said hitting portion and forming a hollow tubular inner core for said handle portion, said plastic shell defining an enclosed hollow cavity which extends substantially without restriction through substantially the entire length of said ball striking element, and opaque gripping means on said inner core for said handle portion; and b. a fluid material in said cavity, said fluid material only partially filling said cavity, said fluid material being visible form the exterior of said ball striking element and flowing freely and without restriction in said all striking element from one end of said cavity to the other end thereof to provide an amusing visual effect during swinging of said device.

2. In the device of claim 1, said liquid comprising colored water.

3. In the device of claim 1, said hitting portion terminating in an outer end, said device further comprising an end cap on the outer end of said hitting portion for protecting said shell at said outer end.

4. In the device of claim 1, said handle portion further comprising a fixed upper ring separating said handle portion from said hitting portion and retaining said gripping sleeve in position on said handle portion.

5. In the device of claim 1, said fluid comprising a gel having a viscosity of between 1,000 and 100,000 centipoise and a lubricant which is nonmiscible with said gel, said lubricant having a viscosity of between 50 centistoke and 200 centistokes.

6. In the device of claim 5, said gel comprising a water based gel, said lubricant comprising an oil.

7. In the device of claim 5, said gel comprising a polysaccharide polymer solution.

8. In the device of claim 7, said gel having a viscosity of between approximately 30,000 and 80,000 centipoise.

* * * * *